US007845255B2

(12) United States Patent
Heinsohn

(10) Patent No.: US 7,845,255 B2
(45) Date of Patent: Dec. 7, 2010

(54) PLIERS

(75) Inventor: Andreas Heinsohn, Wohnsitz (DE)

(73) Assignee: Knipex-Werk C. Gustav Putsch KG, Wuppertal (DE)

( * ) Notice: Subject to any disclaimer, the term of this patent is extended or adjusted under 35 U.S.C. 154(b) by 121 days.

(21) Appl. No.: 11/918,115

(22) PCT Filed: Apr. 7, 2006

(86) PCT No.: PCT/EP2006/061429

§ 371 (c)(1),
(2), (4) Date: Oct. 9, 2007

(87) PCT Pub. No.: WO2006/108804

PCT Pub. Date: Oct. 19, 2006

(65) Prior Publication Data

US 2009/0049960 A1 Feb. 26, 2009

(30) Foreign Application Priority Data

Apr. 9, 2005 (DE) ..... 10 2005 016 356

(51) Int. Cl.
*B25B 7/06* (2006.01)
*B26B 17/00* (2006.01)

(52) U.S. Cl. ..... 81/416; 30/175

(58) Field of Classification Search ..... 81/416, 81/417, 427; 30/173, 175, 254
See application file for complete search history.

(56) References Cited

U.S. PATENT DOCUMENTS 723,356 A * 3/1903 Bayrer ..... 81/416
756,505 A * 4/1904 Kellemen ..... 7/133
772,751 A * 10/1904 Sorensen ..... 81/383
1,843,819 A 2/1932 Jackson
2,274,945 A 3/1942 Keuren (Continued)

FOREIGN PATENT DOCUMENTS

DE 30 47 129 A1 10/1981

(Continued)

OTHER PUBLICATIONS

International Search Report, PCT/EP2006/061429, Aug. 2006.

*Primary Examiner*—David B Thomas
(74) *Attorney, Agent, or Firm*—Collard & Roe, P.C.

(57) ABSTRACT

The invention relates to pliers, especially cutting pliers or crimping pliers, comprising limbs which cross in a single joint in the longitudinal direction thereof, form co-operating working regions on one side of the joint, and embody grips on the other side of the joint. The limbs are interconnected in such a way that they can only rotate in relation to each other, and co-operating recesses are provided on both limbs in order to guide the rotation. A rotational axis of the limbs is located outside the recesses, on the side of the working regions, and a first limb in the joint region is respectively covered, i.e. on both sides, by a lapping part which is connected to the other limb in a fixed manner. The aim of the invention is to provide the inventive pliers with an advantageous structure for the transfer of high gripping forces, also in terms of the forces acting in the joint. To this end, the lapping part is connected to the other limb in such a way that it covers the recesses of the first limb.

18 Claims, 6 Drawing Sheets

U.S. PATENT DOCUMENTS

| | | | | |
|---|---|---|---|---|
| 2,385,835 | A * | 10/1945 | Neal | 30/250 |
| 2,592,927 | A | 4/1952 | Manning | |
| 3,559,515 | A * | 2/1971 | Smith | 81/427 |
| 3,680,212 | A * | 8/1972 | Rozmus | 30/266 |
| 4,414,868 | A * | 11/1983 | Puro | 81/416 |
| 5,752,419 | A | 5/1998 | Liou et al. | |
| 6,176,158 | B1 * | 1/2001 | Chen | 81/417 |
| 6,679,140 | B1 * | 1/2004 | Flavigny | 81/357 |
| 7,258,047 | B1 * | 8/2007 | Wolter et al. | 81/416 |

FOREIGN PATENT DOCUMENTS

| | | | |
|---|---|---|---|
| DE | 197 37 129 | A1 | 3/1999 |
| DE | 199 42 372 | A1 | 3/2001 |
| GB | 599 513 | A | 3/1948 |
| WO | WO 01/17732 | A1 | 3/2001 |

* cited by examiner

PLIERS

CROSS REFERENCE TO RELATED APPLICATIONS

Applicant claims priority under 35 U.S.C. §119 of German Application No. 10 2005 016 356.4 filed Apr. 9, 2005. Applicant also claims priority under 35 U.S.C. §365 of PCT/EP2006/061429 filed Apr. 7, 2006. The international application under PCT article 21(2) was not published in English.

BACKGROUND OF THE INVENTION

1. Field of the Invention

The invention relates to a pliers such as in particular a cutting pliers or a crimping pliers, having a first and a second pliers limb, which pliers limbs cross each other with respect to their elongate extent in a joint, form interacting working regions on one side of the joint and have gripping limbs on the other side of the joint, the pliers limbs being connected to one another only to be rotatable relative to one another and interacting formations being provided on the two pliers limbs for rotational guidance, furthermore an axis of rotation of the pliers limbs lying outside of and on the working region side of the formations, and moreover one pliers limb being covered over in the joint in each case, i.e. on both sides, by an overlapping member which is fixedly connected to the other pliers limb.

2. The Prior Art

In particular in the case of the cutting pliers and crimping pliers mentioned, there is interest in high force action, as is to be achieved by the axis of rotation of the formations lying on the working region side. A pliers of this kind is known for example from WO 01/17732 A1.

Although in the known pliers a very force high ratio is already achieved, it is nonetheless still expensive in production. The regions of the pliers jaws which pass through each other in the engagement region of the pliers jaws, in the joint, provide specifically the necessary anchoring of the pliers limbs relative to one another, but are on the other hand, on account of the opposed penetration, complicated to manufacture, and in regard to force only enable the desired stability to be achieved at high expense. The covering over is only given by a relatively small area. In addition, it is isolated in island manner.

SUMMARY OF THE INVENTION

Proceeding from the above-described state of the art, the invention addresses the objective of providing a pliers such as in particular a cutting pliers or a crimping pliers, which is constructed advantageously for a higher transmission ratio of gripping force, also in regard to the forces acting in the joint.

This objective is met first and foremost by the subject matter of the invention, where it is proposed that the overlapping member is connected to the other limb in overlapping manner relative to the formation of the other pliers limb. There results a bridge-type penetration-free overlap of the one pliers limb by the other pliers limb, specifically on both sides. In this way, high stability is achieved. At the same time, there is achieved here, also in simple manner, for example for a suitable width of the rear part, that the region of the pliers limb in which an openly-located relative movement with respect to one other occurs, is significantly reduced.

The further features of the invention are explained in conjunction with and in continuation of the features described below but may also be of importance in their independent formulation.

It may be provided that the overlapping member is formed integrally with the other pliers limb on both sides. The other pliers limb is then longitudinally slotted in this regard in the joint region. The longitudinal slot is here suitably significantly longer, for example, by a factor of two or more, than equates—in this penetration region—to the width of the pliers limb passing through the slot. For assembly, a corresponding widening of the slit may be effected by warming and it can then be again reduced by squeezing. On account of the formations, the pliers limbs are then immediately non-releasably connected to each other.

On the other hand it is preferred for the overlapping member to be formed as a separate part. This facilitates assembly without the warming action being necessary. Engagement of the individual pliers parts, including the overlapping member, against one another can be effected, and the necessary fixed connection of the parts on the same side of the pliers can be carried out. Also in this, the connection to the other pliers limb may be provided in a positively locking or clamping manner, for example by the overlapping member being pushed on from the side. Preferable however is that the overlapping member is releasably connected to the other pliers limb, specifically for example by a screw thread. Alternatively, riveting may be used. The latter measures are in each case carried out in the same working direction at that in which also the overlapping placement of the individual parts is effected. This is also the case for riveting, since the rivets can be initially positioned, then the other parts, and finally the upstanding rivet heads may be deformed from the same side as that from which the successive placement of the parts against one another is effected.

The securing means such as for example the screws and/or rivets mentioned are also disposed outside the formations. They also do not serve for rotational guidance. They serve only for the securing by means of the separate overlapping gripping member. They extend correspondingly always in the same pliers jaw limb.

The overlapping member can be very easily formed in respect of the functions required of it. For example, it may be formed as a plate member, preferably also with a uniform cross section throughout, this latter with the exception for example of the connecting regions, thus the bores for screws or for an optional positively locking configuration.

In regard to the formations, these may be formed as parts of circles. In this regard, the formations may consist in a variant of a rib on the one pliers limb and a groove on the other pliers limb which is of part circular form and matches the rib. The rib moves correspondingly in the groove in the case of movement of the pliers. Alternatively the formations on both pliers limbs may be formed as grooves and rolling bodies may be provided, accommodated in the formations, in each case formed to roll on the two formations, more or less corresponding to a roller bearing. Thus a low friction interaction of the pliers limbs can be achieved in the joint.

Further it is preferred for the pliers limbs to be biased by means of a spring into the open position of the pliers. Here it is in particular preferred to provide a spring in the covered-over region of the pliers limbs, thus in the joint, the spring being supported in part on the one pliers limb and in part on the other pliers limb. In an advantageous manner, this spring may be a leg spring. It may be installed in such a way that it is not visible from the exterior.

It is also preferred for the one pliers limb to be supported on the other pliers limb on the overlapping region by means of a plastics part. This is not in the region of the pliers limbs which interacts directly in regard to the formations, but in the interaction region of the overlapped pliers limb with the overlapping member. The plastic part may be disposed appropriately on the underside of the overlapping member, specifically the plate member. Instead of a plastics part, a metal part may also be provided, advantageously a part such as has good sliding bearing properties, which property may be in question in first instance also in regard to the plastics part. Alternatively or in addition, the insertion part is also of importance in that it enables the overlapping member to be secured with a suitable preload. This is advantageous for a desired degree of freedom of play in the joint region. Not last, for a suitable choice of material for the overlapping member, this may also be achieved by a correspondingly one-piece formed shoulder of the overlapping portion in this region.

In regard to the formations, it may also be provided that these are formed so that a positively locking securing is achieved against loosening of the insertion connection perpendicular to the joint surface, this for example by a swallow-tail undercut of the formations which interact with each other. In this connection, it is also provided that in a selected position, both withdrawal and thereby initially also assembly are facilitated.

Not last it is preferred for the pliers limbs to be located against one another in the joint without passing through one another.

BRIEF DESCRIPTION OF THE DRAWINGS

The invention is further described below with reference to the accompanying drawing, which however shows only an exemplary embodiment. In the drawing.

DETAILED DESCRIPTION OF THE PREFERRED EMBODIMENTS

Figure 1:
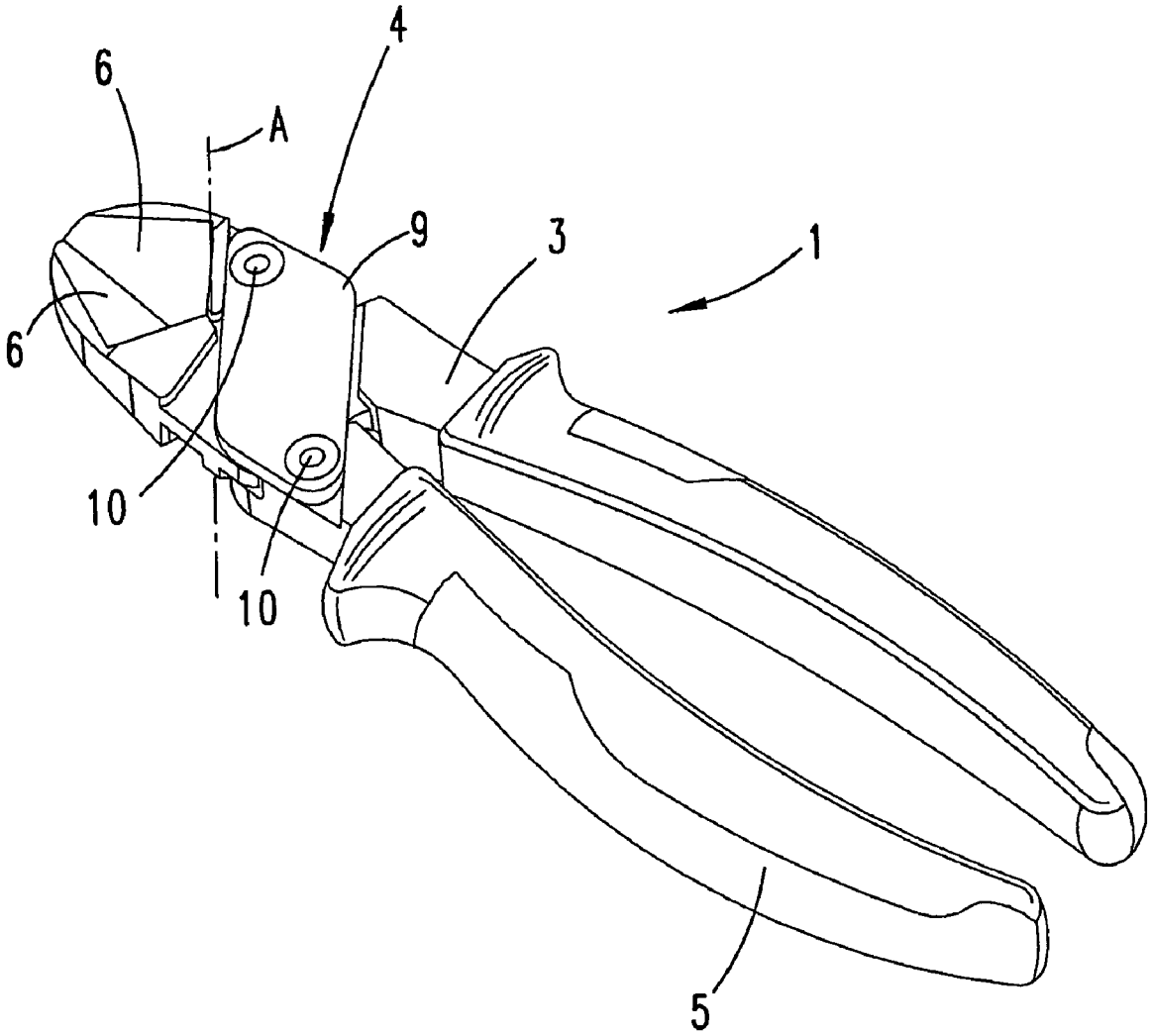
FIG. 1 shows a perspective view of the pliers.

Shown and described in first instance with reference to FIG. 1 to 5 is a pliers 1 which is formed as a cutting pliers.

The pliers 1 has a first pliers limb 2 and a second pliers limb 3. The pliers limbs 2, 3 cross over with respect to their elongate extent in a joint 4.

On one side of the joint 4, gripping limbs 5 are formed, and on the other side of the joint 4, working regions 6, which have cutters corresponding to the construction as a cutting pliers.

Figure 2:
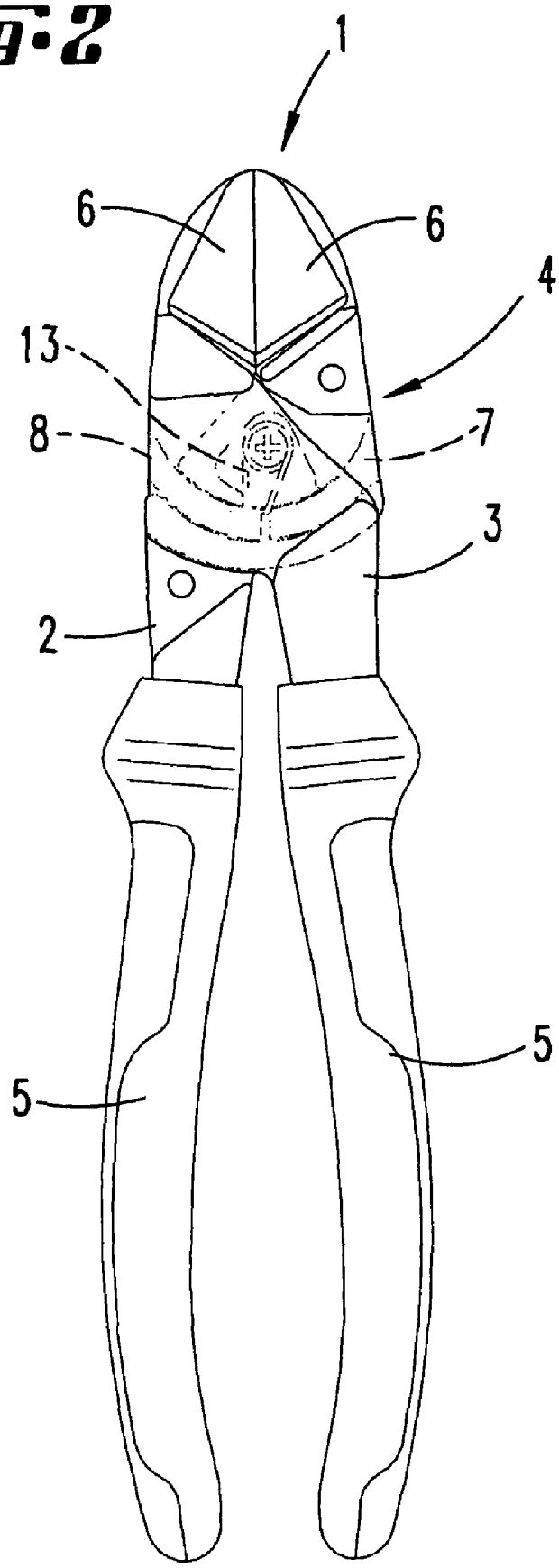
FIG. 2 shows a plan view of the pliers according to FIG. 1, in a closed position, with the formations which are located covered-over being shown, an overlapping member being removed.
Figure 3:
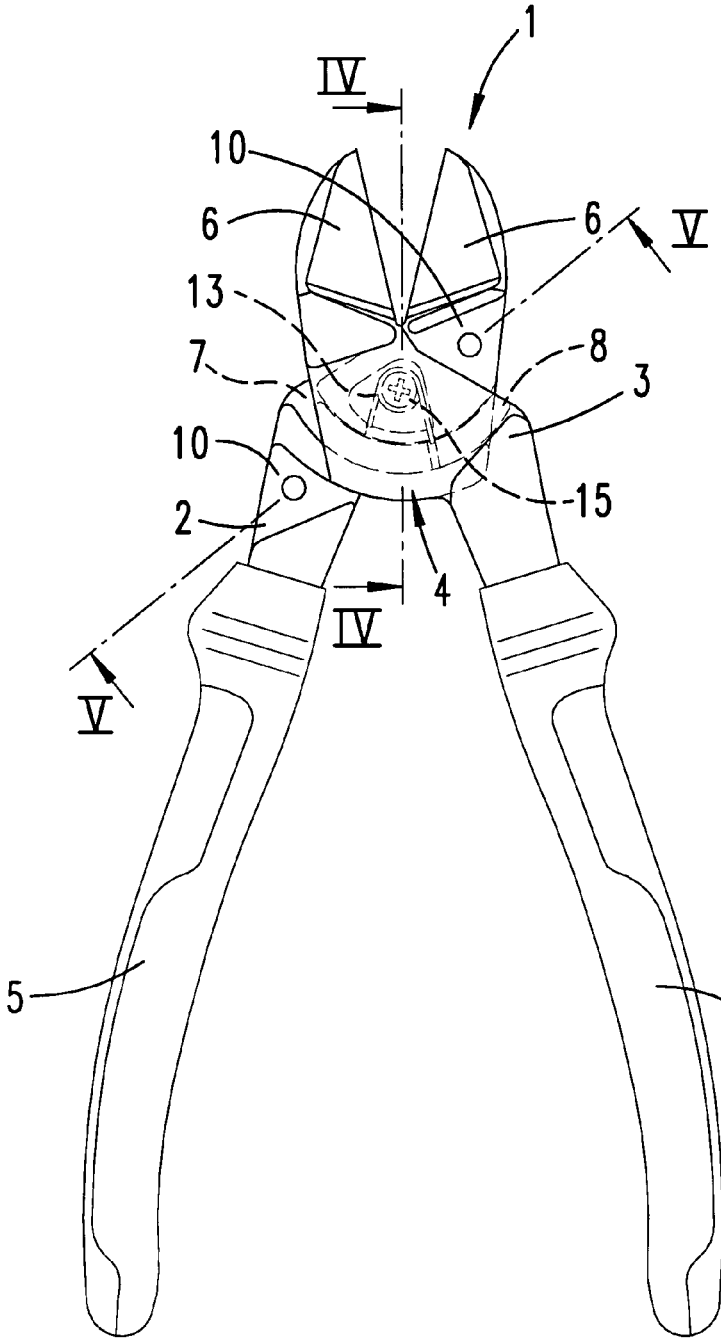
FIG. 3 is a representation corresponding to FIG. 2, with the pliers open.
Figure 4:
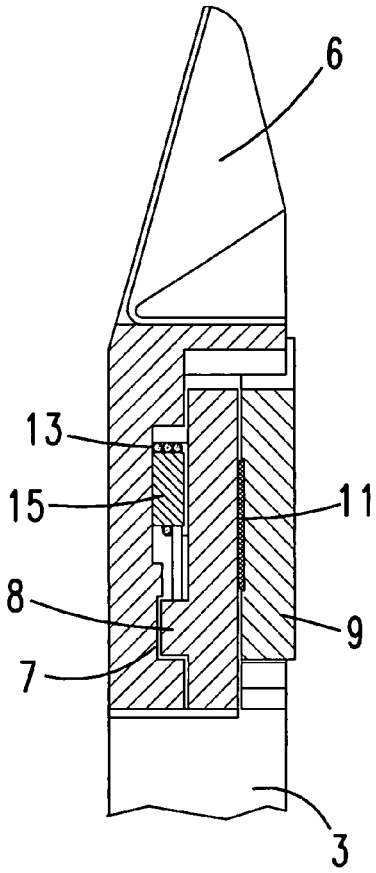
FIG. 4 is a cross-section through the subject according to FIG. 3, cut along the line IV-IV, but with the overlapping member.
Figure 5:
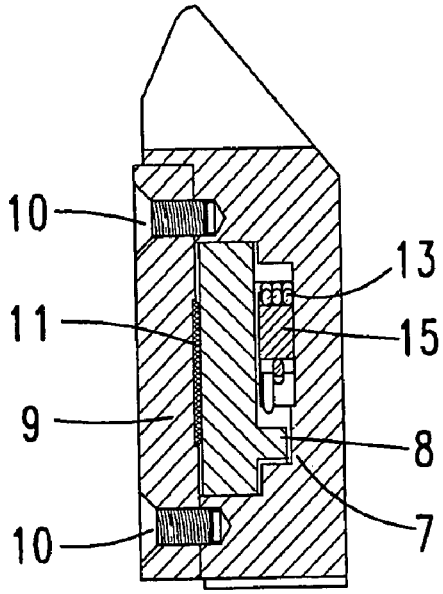
FIG. 5 is a cross-section through the subject according to FIG. 3, cut along the line V-V.
Figure 6:
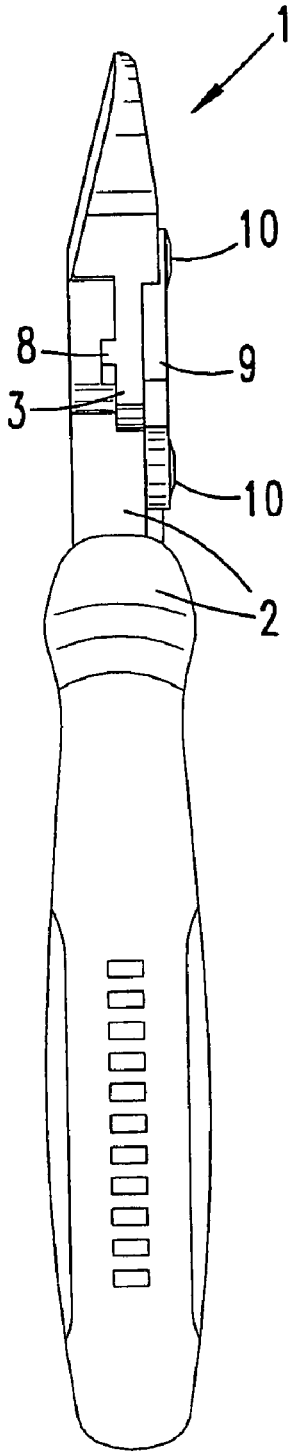
FIG. 6 is a side view of the pliers according to FIG. 1.
Figure 7:
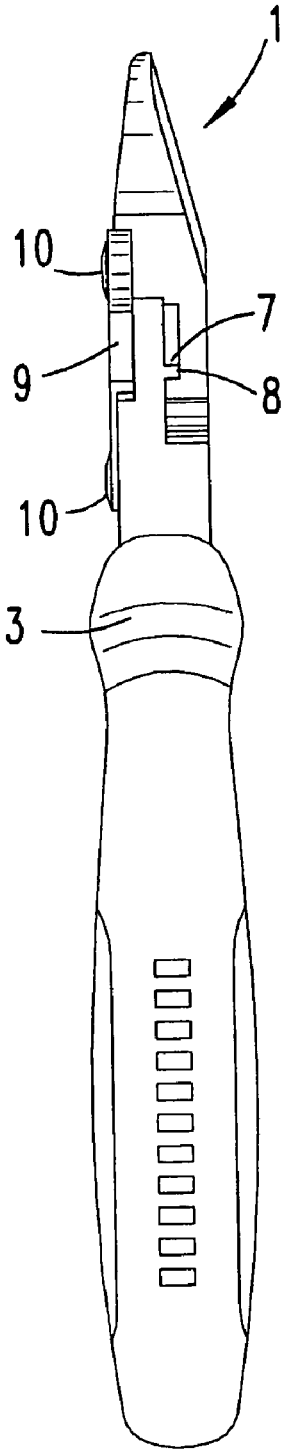
FIG. 7 is a side view of the pliers according to FIG. 1, on the opposite side from the representation according to FIG. 6.

The pliers limbs 2, 3 are arranged to be rotatable relative to one another between a closed position according to FIGS. 1, 2 and an open position according to FIG. 3.

The rotatability is formed in such a way that an axis of rotation A is on the working region side of the joint 4, a virtual axis being here in question.

Figure 8:
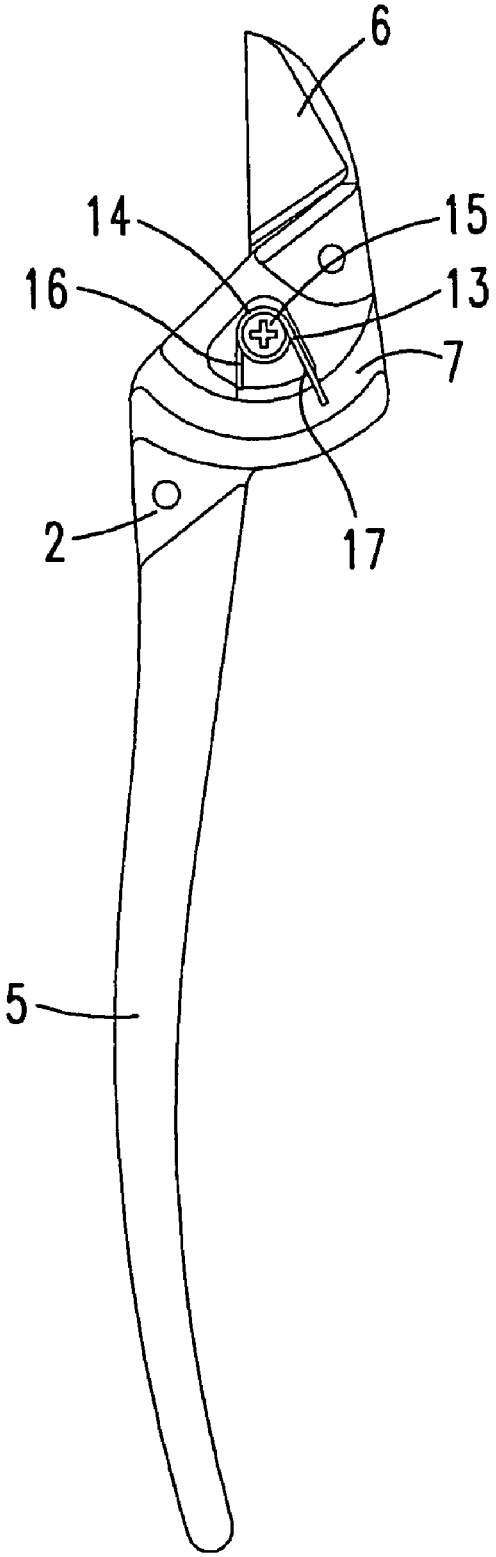
FIG. 8 is a representation of one of the limbs of the pliers, looking onto the formations.
Figure 9:
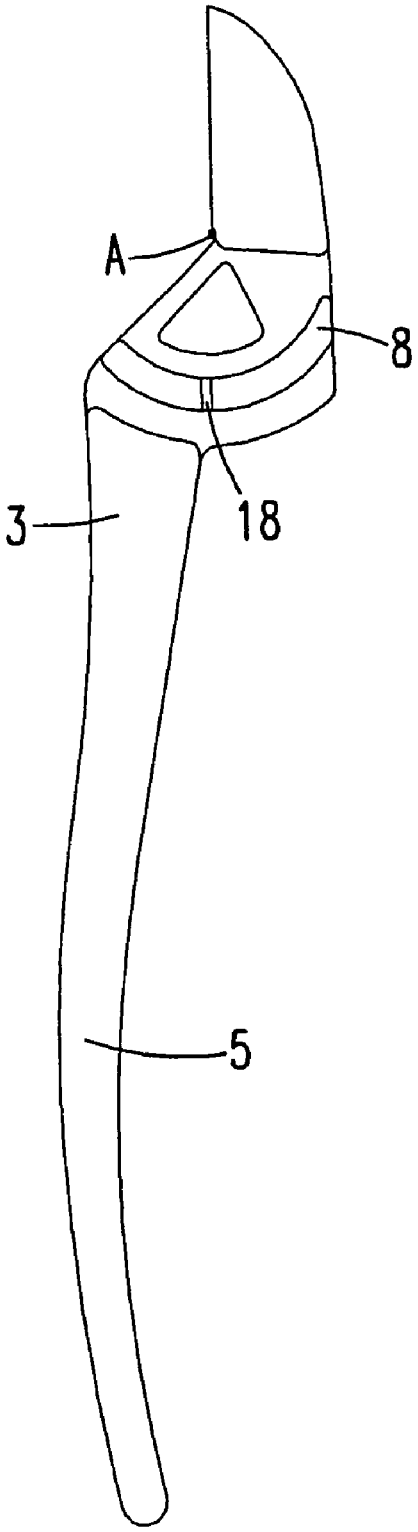
FIG. 9 is a representation of the other limb of the pliers, looking onto the formations.

On both pliers limbs 2, 3, formations are defined for guiding the rotation, namely, as is seen from FIGS. 8 and 9, a groove 7 on the one pliers limb 2 and a rib 8 on the other pliers limb 3. The arcuate guidance of the formations 7, 8 corresponds to a circle having a radius about the axis of rotation A.

The one pliers limb 3 is furthermore overlapped in the region of the joint 4 on both sides by the other pliers limb 2 by means of an overlapping member 9; specifically, on the one side, the underside in the representation according to FIG. 1, the overlapping member 9 is formed directly by the pliers limb 2 itself, and on the upper side by a separate overlapping member 9. This is also seen in further details from FIGS. 4 and 5.

The separate overlapping member 9 is connected to the second pliers limb 2 in the case of the exemplary embodiment by two screws 10. Both overlapping members 9 are disposed in overlapping manner with respect to the formations 7 and 8.

As an alternative, which is not shown in the exemplary embodiment, the overlapping member 9 may also be formed integrally from the same material as the pliers limb 2. In this case, the pliers limb 3 is covered over in the region of the joint on both sides by the integral overlap of the second pliers limb 2.

The overlapping member 9 formed in the case of the exemplary embodiment as a separate component is clearly formed as a plate member, specifically in the case of the exemplary embodiment to have a rhombus-shaped outline. The narrow sides are in this case associated with the side edges of the pliers. By contrast, the elongate sides of the rhombus-shaped outline are respectively associated with the working regions and the gripping regions of the pliers.

Figure 10:
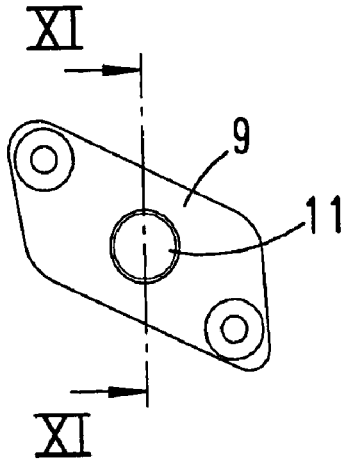
FIG. 10 is a view from below of the overlapping member.
Figure 11:
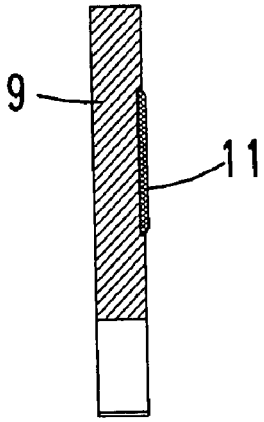
FIG. 11 is a section through the subject according to FIG. 10, cut along the line XI-XI.

The separate overlapping member 9 is further, in the case of the exemplary embodiment, as is seen from FIGS. 10 and 11, provided on the underside with a plastics insert 11. In regard to the plastics, this may be polyamide or PTFE. Alternatively, a metal insert, such as for example a brass component, may be provided. Relevant on one hand is a sliding bearing capability for the insert, and on the other hand, to enable sufficient stability for tightened securing of the overlapping member, this latter being optionally the only requirement.

Figure 12:
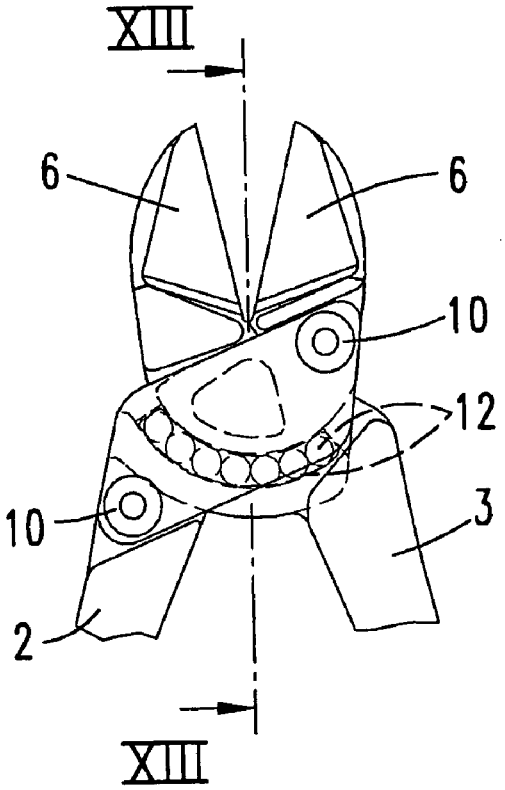
FIG. 12 is an alternative embodiment of the pliers with ball-shaped bodies in the joint.
Figure 13:
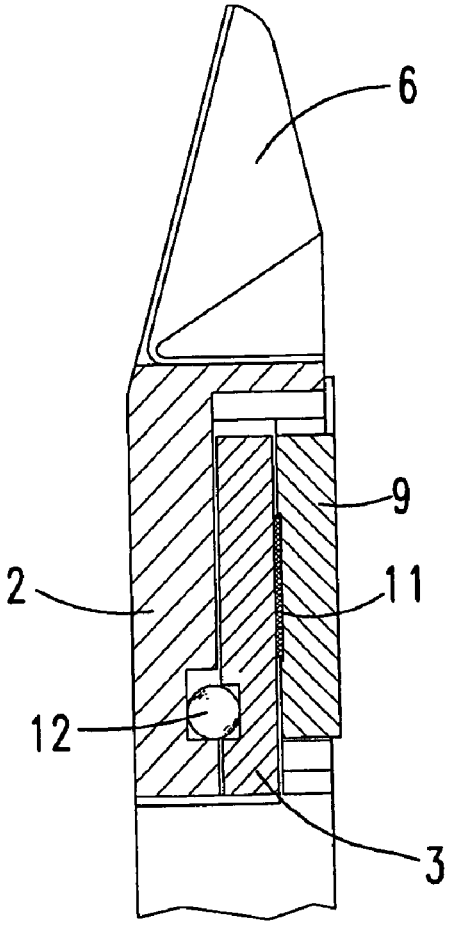
FIG. 13 is a cross-section through the subject according to FIG. 12, cut along the line XIII-XIII.

As an alternative to the illustrated and described formations 7, 8, there may also be formed on the two pliers limbs, grooves which face one another in the assembled condition, in which balls 12, substantially corresponding to a roller bearing, are inserted. The support is then effected on both sides only by the balls. At the end of the grooves, a barrier feature or the like must be provided, so that the balls cannot roll out. Such an embodiment is shown in FIGS. 12 and 13.

It is of further importance that the pliers according to the first embodiment, which may however also be provided in the further embodiments, is preloaded into its open condition according to FIG. 3 by means of a spring 13, which specifically is formed as a leg spring. For this purpose there is provided in the pliers limb 2, see FIG. 8, a recess 14, on the working region side of the formation 7, into which the spring 13, which is rotatably moveable about a pin 15, is inserted, the pin 15 being realised in the exemplary embodiment as a screw. A short limb 16 of the spring 13 is supported on the pliers jaw 2, while, in the assembled condition, and in a position which is narrower than as represented in FIG. 3, the other limb 17 is supported on the rib 8 of the pliers limb 3. For this purpose, a transverse groove 18 is formed in the rib 8, in which, in the assembled condition, the limb 17 of the spring 13 is located.

The pliers limbs 2, 3 are mounted in the joint to be rotatable only with respect to one another but not to be displaceable in the elongate direction.

All disclosed features are (in themselves) pertinent to the invention. The disclosure content of the associated/attached priority documents (copy of the prior application) is also hereby incorporated in full in the disclosure of the application, also for the purpose of incorporating features of these documents in claims of the present application.

The invention claimed is:

1. Pliers (1) such as in particular a cutting pliers or a crimping pliers, having pliers limbs (2, 3), which pliers limbs (2, 3) cross each other with respect to their elongate extent in a joint (4), form interacting working regions (6) on one side of the joint (4) and have gripping limbs (5) on the other side of the joint (4), the pliers limbs (2, 3) being connected to one another only to be rotatable relative to one another and interacting formations (7, 8) being provided on the two pliers limbs (2, 3) for rotational guidance, corresponding to a circle having a radius about an axis of rotation (A) of the pliers limbs (2, 3) which axis of rotation (A) is lying outside and on the working region side of the formations (7, 8), the interacting formations being distanced radially from the axis of rotation, and moreover, one pliers limb (3) being covered over in the joint (4) in each case, i.e. on both sides, by an overlapping member (9) which is fixedly connected to the other pliers limb (2), wherein the overlapping member (9) is connected to the other pliers limb (2) in overlapping manner relative to the formations (7, 8) of the one pliers limb (3), and wherein the interacting formations (7, 8) are part circular shaped and said interacting formations (7, 8) comprise a rib (8) on the one pliers limb (3) and a groove (7) on the other pliers limb (2), the groove being matched to the rib (8) and being of part circular form.

2. Pliers according to claim 1, wherein the overlapping member (9) is formed integrally with the other pliers limb (2) on both sides.

3. Pliers according to claim 1, wherein in the case of an integral construction of the overlapping members (9), a longitudinal slot is formed between the overlapping members in the other pliers limb, the length of the slot significantly exceeding the width of the other pliers limb in the joint region.

4. Pliers according to claim 1, wherein the length of the slot of the other pliers limb exceeds the associated width of the one pliers limb by a factor of two or more.

5. Pliers according to claim 1, wherein the overlapping member (9) is formed at least on one side as a separate part.

6. Pliers according to claim 1, wherein the separate overlapping member (9) is releasably connected to the other pliers limb (2).

7. Pliers according to claim 1, wherein the separate overlapping member (9) is screwed to the other pliers limb (2).

8. Pliers according to claim 1, wherein the separate overlapping member (9) is riveted to the other pliers limb (2).

9. Pliers according to claim 1, wherein the separate overlapping member (9) is formed as a plate member.

10. Pliers according to claim 1, wherein the formations (7, 8) are in the form of portions of a circle.

11. Pliers according to claim 1, wherein a spring (13) is provided in the covered-over region of the pliers limbs (2, 3), the spring being supported in part on the one pliers limb and in part on the other pliers limb.

12. Pliers according to claim 11, wherein the spring (13) is not visible from the outside.

13. Pliers according to claim 11, wherein the spring (13) is a leg spring.

14. Pliers according to claim 1, wherein the one pliers limb (3) is supported on the other pliers limb (2) in the overlapping region by means of a plastics part (11).

15. Pliers according to claim 1, wherein the plastics part (11) is formed on the underside of the separate overlapping member (9).

16. Pliers according to claim 1, wherein the formations (7, 8) stand in overlap with one another at right angles to the joint surface, insertion connection or pull-out release of the pliers limbs in a direction perpendicular to the joint surface being possible in a selected position of the pliers limbs (2, 3).

17. Pliers according to claim 1, wherein the pliers limbs (2, 3) lie against one another in the joint without passing through one another.

18. Pliers (1) such as in particular a cutting pliers or a crimping pliers, having pliers limbs (2, 3), which pliers limbs (2, 3) cross each other with respect to their elongate extent in a joint (4), form interacting working regions (6) on one side of the joint (4) and have gripping limbs (5) on the other side of the joint (4), the pliers limbs (2, 3) being connected to one another only to be rotatable relative to one another and interacting formations (7, 8) being provided on the two pliers limbs (2, 3) for rotational guidance, corresponding to a circle having a radius about an axis of rotation (A) of the pliers limbs (2, 3) which axis of rotation (A) is lying outside and on the working region side of the formations (7, 8), the interacting formations being distanced radially from the axis of rotation, and moreover, one pliers limb (3) being covered over in the joint (4) in each case, i.e. on both sides, by an overlapping member (9) which is fixedly connected to the other pliers limb (2), wherein the overlapping member (9) is connected to the other pliers limb (2) in overlapping manner relative to the formations (7, 8) of the one pliers limb (3), wherein the formations on the two pliers limbs (2, 3) are formed as grooves and wherein rolling bodies (12) are provided, accommodated in the formations, the bodies being formed in each case to roll on the two formations.

* * * * *